United States Patent [19]

Josefsson

[11] 4,032,333

[45] June 28, 1977

[54] ROLLED STEEL MATERIALS

[75] Inventor: Erik Anders Ake Josefsson, Borlange, Sweden

[73] Assignees: Stora Kopparbergs Bergslags Aktiebolag, Falun; Granges Aktiebolag, Stockholm, both of Sweden

[22] Filed: Dec. 19, 1974

[21] Appl. No.: 534,300

[30] Foreign Application Priority Data

Dec. 28, 1973 Sweden ..... 7317600

[52] U.S. Cl. ..... 75/124; 75/123 AA; 75/126 M; 75/128 P; 148/36

[51] Int. Cl.[2] ..... C22C 38/06; C22C 38/60

[58] Field of Search ..... 75/123 R, 123 AA, 126 M, 75/128 P; 148/36

[56] References Cited

UNITED STATES PATENTS

| | | | |
|---|---|---|---|
| 1,992,905 | 2/1935 | Wills | 75/123 R |
| 2,009,714 | 7/1935 | Palmer | 75/123 AA |
| 2,236,716 | 4/1941 | Morris | 75/123 AA |
| 2,258,604 | 10/1941 | Gagnebin | 75/123 AA |
| 3,671,336 | 6/1972 | Korchynsky et al. | 148/36 |

FOREIGN PATENTS OR APPLICATIONS

| | | | |
|---|---|---|---|
| 1,128,268 | 9/1968 | United Kingdom | 75/123 AA |
| 1,170,569 | 11/1969 | United Kingdom | 75/123 AA |

OTHER PUBLICATIONS

*Journal of Metals*, July 1965, pp. 769–775.

*Primary Examiner*—Arthur J. Steiner
*Attorney, Agent, or Firm*—Curtis, Morris & Safford

[57] ABSTRACT

The invention refers to constructions of rolled steel materials and to a process for the preparation of such constructions. The invention resides in the improvement of using, in the parts of said construction where the estimated tensile stress component in any direction perpendicular to the rolling direction of the material is equal to or greater than the estimated tensile stress component in the rolling direction of the material, a steel containing about 0.002 – 0.05 % by weight of sulphur and tellurium in an amount of about 0.002 – 0.009 % by weight + about 0.1 times the sulphur content in % by weight, the content of silicate bound oxygen being less than about 300 parts per million.

1 Claim, 3 Drawing Figures

DEFINITION OF DIRECTIONS

THICKNESS-LENGTH RATIO OF MANGANESE SULPHIDES (MEASURED ON MICROPHOTO OF LONGITUDINAL SECTION OF 15 mm HOT-ROLLED PLATE) AS A FUNCTION OF THEIR Te-CONTENTS ACCORDING TO MICROPROBE ANALYSIS.

Fig.3 SULPHIDES OF CONTINUOUS-CAST BLANKS OF STEEL HAVING THE ANALYSIS :

| C | Si | Mn | P | S | Al | N |
|---|---|---|---|---|---|---|
| .12 | .30 | 1.22 | .012 | .015 | .06 | .005 |

IMAGE ENLARGEMENT: 200 x a) WITHOUT Te
VX 3112 b) WITH .007% Te
VX 3115

ROLLED STEEL MATERIALS

The present invention refers to constructions of rolled steel materials as well as a process for their manufacture, wherein the material is subjected to high tensile stresses in directions deviating from the rolling direction.

When rolling steel the material usually obtains different characteristics in the rolling direction (equal to the main elongation direction in the hot processing) and perpendicular thereto. For flat products it is also possible to differ between the characteristics in the rolling plane and a plane perpendicular thereto.

With reference to the drawings herein:

FIG. 3 illustrates sulphide dispersion in conventional rolled steels and rolled steel according to the present invention.

Figure 1:
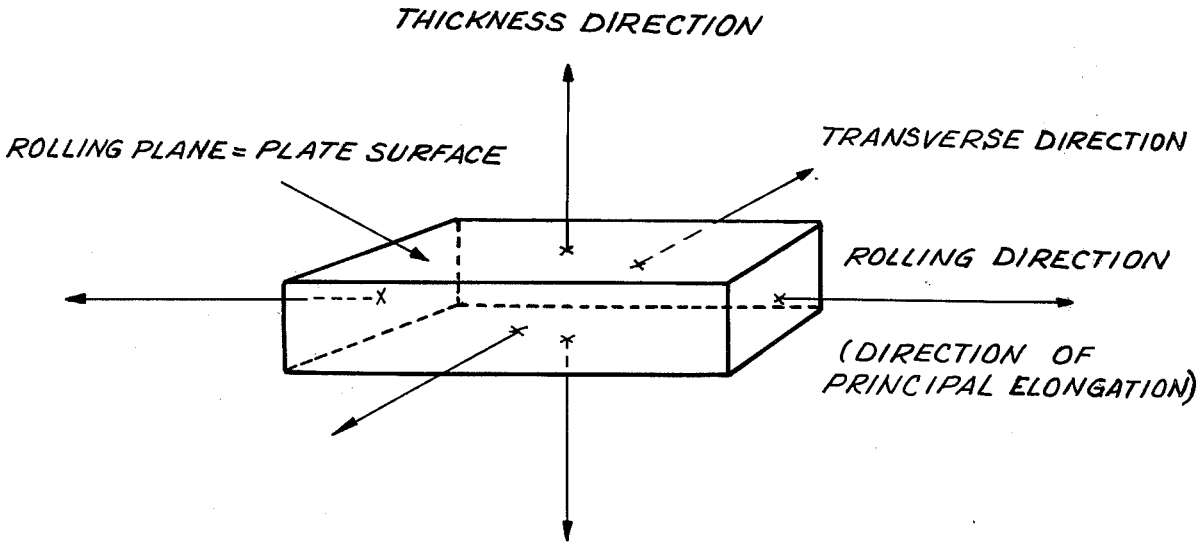
FIG. 1 illustrates, in a rolled steel, the herein discussed directions of interest.

Thus, particularly the toughness is considerably lower perpendicular to the rolling direction than parallel thereto. This is especially a disadvantage for flat products, for instance sheet, plate or strip, where in use it is not always possible to pay consideration to the rolling direction. Usually, it is tried to position the material in the construction so that the highest tensile load is exerted in the longitudinal direction of the band, plate or sheet. For instance, when building ships the plates of the hull are positioned alongside. However, it would be valuable if for instance when building a ship it would be possible section-wise to position at least part of the plates transversally of the ship.

Pipelines for the transportation of gas, oil, water and other gaseous, liquid or slurried media are manufactured from sheet or plate having a longitudinal joint, from strips having a helix joint and particularly in smaller dimensions without joint. In these products an inner overpressure results in a load, the biggest component of which is directed circumferentially and perpendicularly to the longitudinal direction of the tube, i.e. in a direction deviating from the rolling direction. The circumferential stresses may result in cracks in the longitudinal direction of the tubes (or with regard to helix welded tubes helically along the weld joint) if the strength and toughness of the steel in the circumferential direction deviating from the rolling direction are sufficiently high.

Another case when the material may be subjected to tensile loads in directions deviating from the rolling direction is in welds in T-, L- or cross-joints or similar constructions, for instance when welding reinforcements against the skin or other parts of a hull, when lifting ears are welded to containers and in a plurality of other cases. Here there is need for ability of withstanding loads in the direction of the thickness, i.e. perpendicular to both the rolling direction and the plane of the sheet or the plate.

Under transverse stresses the ductility is particularly critical when bending over a small edge radius, the bending axis extending parallel to the rolling direction. This is of a great importance for a manifold of constructions manufactured by shaping sheet, plate or strip in a cold condition by means of bending. A typical example of this are flanges and reinforcements of beams and frameworks, where, of course, one must accept bending also with the axis of bending extending along the rolling direction.

In many cases the construction could be given a better and cheaper design if for a reasonable cost one could use sheet or plate qualities having a better transverse toughness than of those now on the market. A rational way of obtaining this is of course to make the material more isotropic, i.e. to eliminate the causes of the reduction in toughness in directions deviating from the rolling direction.

According to the invention there is used for the parts of construction which may be subjected to strong tensile loads in directions deviating from the rolling direction steels containing 0.002 – 0.05 percent by weight of sulphur, and tellurium in an amount of 0.002 – 0.009 percent by weight +0.1 times the sulphur content in percent by weight. Thus, it has quite surprisingly shown that by using such small amounts of additives the characteristics of the steel are significantly improved in the directions deviating from the rolling direction. It is previously known that small amounts of tellurium improve the toughness of the steel in the rolling direction, but so far no one has observed that these small amounts above all effect the anisotropy of rolled steels from the point of view of toughness.

This anisotropy of the rolled material may above all be dependent on the fact that heterogeneities of the material are extended in the rolling direction. In flat products the rolling, moreover, takes place essentially in one plane, which results in the heterogeneities being extended in this plane thus resulting in maximum influence on the characteristics perpendicular to the rolling plane. Among such heterogeneities particularly the sulphide inclusions have been found to have a direct connection with the toughness of the material perpendicular to the rolling direction. Therefore, it has been attempted to influence this characteristic by lowering the sulphur content of the steel or by effecting the characteristics of the sulphide inclusions. In certain cases the sulphur content has been lowered to a value below 0.005%, which results in a certain improvement but requires a particular desulphurization operation. Moreover, this low sulphur content may in some cases be disadvantageous.

Also different sulphur-binding metals, such as Zr, Ti, Ca and rare earths have been added, said metals having greater affinity to the sulphur than has manganese, thereby replacing the manganese in the sulphide inclusions. The sulphides thus formed are harder than the manganese sulphide and are not deformed during the rolling to elongated inclusions. However, these metals primarily bind oxygen and nitrogen and must therefore be supplied in a certain excess corresponding to the quantitites of oxygen and hydrogen which have not been satisfactorily bound by for instance aluminum. Since a complete binding of the whole sulphur content is required the amount will necessarily be high, often 1–2 kgs/ton, and the cost therefore correspondingly high.

Figure 2:
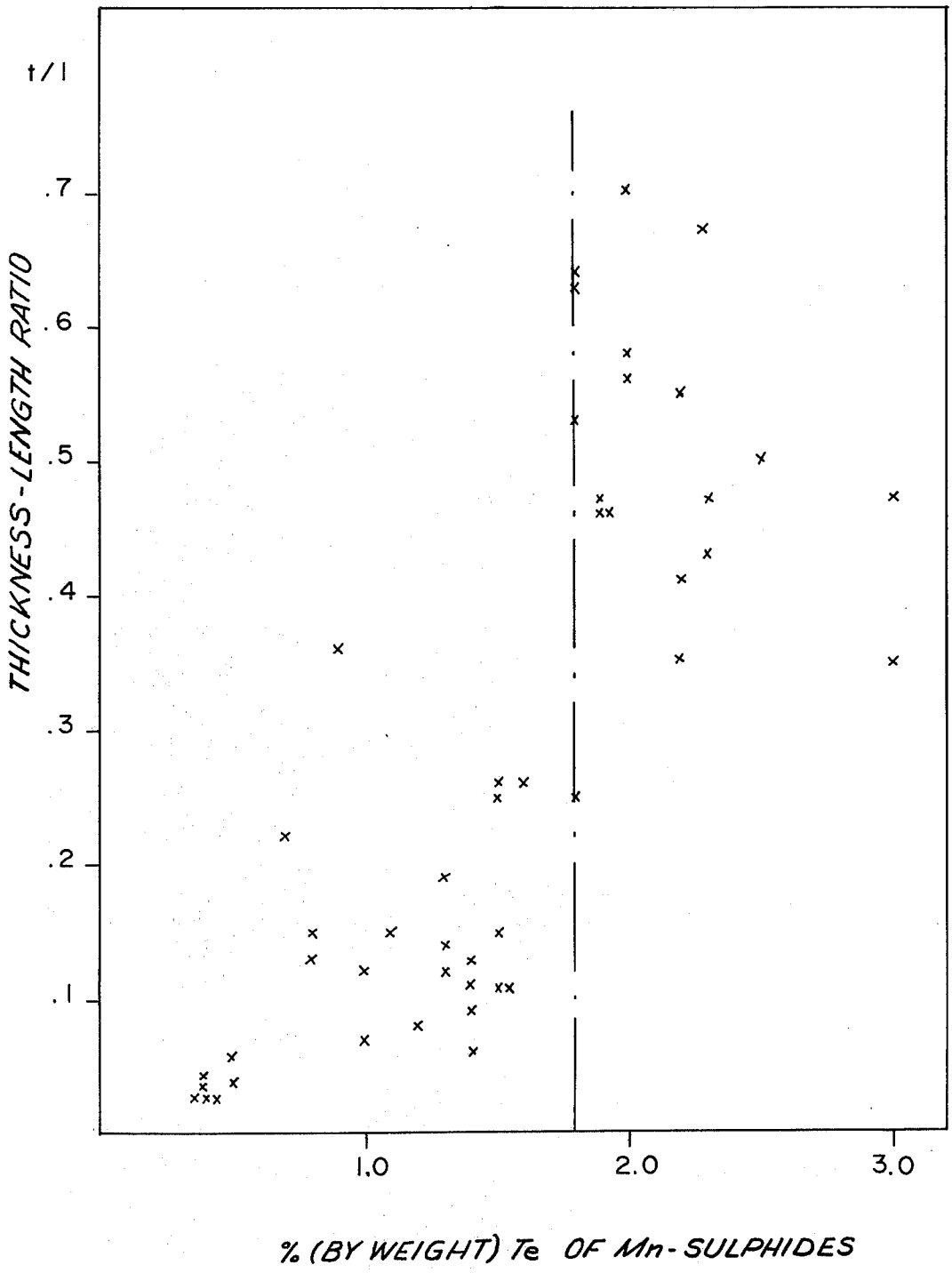
FIG. 2 illustrates the thickness to length ratio, based on tellurium content and inclusions according to a microprobe analysis.

Like sulphur tellurium forms relatively soft compounds with manganese and iron and has previously been used in greater amounts than suggested here in order to improve the cutability of the steel. At the concentrations defined in the claim no noteworthy amounts of pure telluride are, however, formed, but the tellurium instead forms a solid solution with the manganese sulphide which thereby obtains an increased hardness and is deformed to a much lesser extent in the rolling than does the pure manganese sulphide. In this way the transverse toughness is considerably improved. Measurements of the thickness-length ratios (t/l-ratio) of the sulphide inclusions of varying Te-content in longitudinal section from 15 mms hotrolled plate have been made. The same inclusions have been analyzed by means of a microprobe. It has been established, on the one hand that a very strong increase of the t/l-ratio - from <0.05 to >0.35 - takes place when the Te-content of the inclusions increases from <1% to >2% (see FIG. 2), and on the other hand that the maximum Te-amount of this type of inclusions having a high t/l-ratio lies between 3 and 4%. Since the S-content of the inclusions at the same time was about 35% it can be concluded that a Te-amount of 0.06–0.1 × the sulphur content will be required to obtain the desired effect. (In FIG. 2 a vertical dash-and-dot line has been drawn at a Te-content of appr. 1.8%, dividing the diagram in a low ratio area and a high ratio area (t/l)). In addition, there is a basic amount of Te relatively independent of the sulphur content and corresponding to the solubility (including the grain interphase adsorption) in the metallic phase from which the sulphide inclusions have been precipitated. This amount varies probably in dependence on the remaining analysis and on the solidification conditions but seems to lie between 0.002 and 0.009%. The optimum Te-content of the steel may thus be expressed as [0.002 to 0.009% + (0.06 to 0.1) × the sulphur content]. If this content is exceeded a progressively increased amount of a phase having a higher Te-content will be present, which phase, contrary to the sulphide with about 3% of Te, is easily deformed at the hot working temperature and therefore counteracts the purpose of the invention.

As indicated above, Te influences the sulphides also in steel having relatively high oxygen contents. In this way it differs from for instance Ce and other rare earths. However, a high oxygen content may per se contribute to a low ductility in the transverse and thickness directions, namely if it is present as easily rollable silicates. In an experiment wherein Te-containing and Te-free materials having the same basic analysis were compared it has thus been found that when the oxygen concentration present mainly as Mn-silicates was 300 ppm the area contraction in a tensile test in the thickness direction was only 10%, irrespective whether Te had been added or not. When the oxygen content and thereby the portion of elongated silicate inclusions were reduced the difference between Te-containing and Te-free materials was more and more pronounced, and when this oxygen content was below 100 ppm the contraction values exceeded in average 40% of those of the Te-treated material, whereas for the non-Te-treated material it was still between 10 and 15%. In this case the sulphur content was 0.020%.

In addition to the ability of making the manganese sulphides more resistant to deformation during hot-rolling, tellurium has also a marked influence on the way they are present in the structure. In a well deoxidized steel — which according to the statements of the above paragraph is a basic condition for good characteristics transversely and thickness-wise - the sulphides are as a rule precipitated in swarms or rows in the grain interphase corners and grain interphases of the solidified structure (see FIG. 3*a*). Irrespective of whether the discrete sulphide particles are flattened or not during rolling such presence of the sulphides results in the presence of extended zones in the rolled material in the rolling plane corresponding to the grain interphases with abundant presence of sulphide particles. These particles will then form weak zones with similar weakening action as that of separate flattened sulphides. In view of the Te-addition the sulphides are instead precipitated evenly distributed during the solidification (FIG. 3*b*, where they are almost invisible), so that said sulphide-enrichments in the grain interphases do not form and thus not the weakness zones dependent thereon either. A significant part of the improvement in characteristics seems to be the result of this circumstance.

As is clear from the above the increased transverse ductility or toughness is wholly related to the influence of the tellurium on the form of the sulphide slag, and the effect is therefore principally - disregarding secondary effects as for instance from oxygen according to the above - independent of the remaining composition of the steel. Therefore, the invention relates to all kinds of steels, unalloyed and low-alloyed steels, normally used as indicated in the introductory part of this disclosure, i.e. practically within the following ranges (the figures relates to percent by weight): 0.01 – 0.35 percent C, up to 1.0 percent Si, 0.3 – 5 percent Mn, up to 3 percent Cr, up to 10 percent Ni, up to 1 percent Mo, up to 0.15 percent Nb, up to 0.15 percent V, up to 0.6 percent Cu, 0.0005 – 0.1 percent Al, up to 0.030 percent N, up to 0.006 percent B and a normal percentage of contaminating elements.

In this disclosure the term "rolled steel materials" refers to all kinds of materials resulting from a flattening operation, viz. rolling. Among the usual materials of this kind the most common are: Plate, sheet and strip. The invention should in no way be construed to be delimited to any particular kind of rolled steel materials but encompasses any kind of such rolled material.

The invention will be further illustrated by the following non-limiting examples.

EXAMPLE 1.

The following table 1 shows as a result from Charpy V-testing (30 kpms pendulum) the brittle transition temperature (criterion 50% crystalline break) and impact work at this temperature for two types of steels, wherein the content of tellurium has been varied. Moreover, the table states the ratio between the value of the impact work at fully tough break ($vE_{100}$) for transverse test ( ⊥ ) and the same value for a longitudinal test ( = ). The steel has been rolled to flat iron with a thickness of 15 mms and has been tested in the rolling direction ( = ), and perpendicular ( ⊥ ) thereto in the rolling plane. All steels have been normalized twice.

Table 1

| | Analysis | | | | | | | | | Brittle transit. temp. °C | | Impact work °C | | $vE_{100}$ ⊥/ |
|---|---|---|---|---|---|---|---|---|---|---|---|---|---|---|
| Test | C | Mn | Si | P | S | N | V | Te | Al-solub. | = | ⊥ | = | ⊥ | $vE_{100}$ = |
| A | .13 | 1.5 | .40 | .003 | .015 | .003 | — | 0 | .038 | −30 | +30 | 16 | 8 | .57 |

Table 1-continued

| Test | Analysis C | Mn | Si | P | S | N | V | Te | Al-solub. | Brittle transit. temp. °C = | ⊥ | Impact work °C = | ⊥ | $vE_{100}\perp/vE_{100}=$ |
|---|---|---|---|---|---|---|---|---|---|---|---|---|---|---|
| B | .13 | 1.5 | .40 | .003 | .015 | .003 | — | .004 | .028 | .50 | − 5 | 16 | 17 | .82 |
| C | .13 | 1.5 | .40 | .003 | .015 | .003 | | .012 | .031 | −60 | − 5 | 17 | 14 | .83 |
| D | .12 | 1.5 | .40 | .003 | .014 | .013 | .11 | — | .002 | −60 | −30 | 15 | 8 | .49 |
| E | .12 | 1.5 | .40 | .003 | .014 | .010 | .11 | .004 | .013 | −80 | −30 | 15 | 12 | .60 |
| F | .12 | 1.5 | .40 | .020 | .014 | .011 | .11 | .005 | .003 | −50 | −30 | 15 | 10 | .67 |
| G | .12 | 1.5 | .40 | .003 | .014 | .013 | .11 | .007 | .007 | −70 | −50 | 17 | 12 | .71 |

It is clear from the table that particularly the toughness of the transverse direction is considerably increased by the addition of tellurium within the limits stated. As a result the ratio $vE_{100}\perp/vE_{100}=$ increases significantly which means that the anisotropy with regard to the toughness is reduced. It is also clear that tellurium in these small amounts has a fine grain forming effect, particularly with regard to steels A-B-C, wherein the fine grain effect of AlN is small in view of a low content of nitrogen. Also with regard to steels D-G, which are fine grain treated with vanadium and nitrogen the addition of tellurium in an increase toughness in the transverse direction.

EXAMPLE 2

Sulphide inclusions flattened by rolling are usually regarded to cause the tendency for breakage in heavy plate at tensile stresses perpendicular to the rolling plane called "lamellar tearing." That such breakage is effectively counteracted by addition of tellurium is shown by the following experiments:

From a charge having the base analysis C = 0.17, Si = 0.42, Mn = 1.30, P = 0.024, S = 0.026 an ingot was prepared having Te added thereto to a content of 0.007%. The ingot was rolled to a 15 mm plate and compared with a plate rolled in the same way from an ingot from the same charge but without addition of Te, the test being made with a tensile load perpendicular to the rolling direction. Whereas the plate from the ingot not having Te added thereto gave a maximum tensile ultimate stress of 42–52 kp/mm² and a pronounced lamellar break the Te-containing material gave ultimate strength values of 60–61 kp/mm², i.e. largely the same as when testing parallel to the rolling direction. The surface of fracture of the Te-containing material displayed no or insignificant traces of layering.

EXAMPLE 3.

With three different plates having a thickness of 25 mm from one end and the same charge cross-weld joints were made, i.e. a tension plate was welded to each side of each test plate, perpendicular to the welding surface thereof, so that the test plate across its whole thickness was welded between the two tension plates. Two of the test plates had been rolled from ingots wherein Te had been added at an analyzed content of 0.011%, whereas to the third one no such addition had been made. Otherwise the steel had the following analysis:

| C | Si | Mn | P | S | N | Al | |
|---|---|---|---|---|---|---|---|
| .13 | .25 | 1.2 | .010 | .015 | .011 | .04 | % |

From the composite materials test bars were cut having a cross-section of 15 × 30 mm and the longitudinal direction of the bar being perpendicular to the rolling surface of the test plate. From the two Te-containing plates in all 32 bars were taken. In all cases ultimate tensile strength values were obtained lying within the limits 48.2 – 55.6 kp/mm². From the Te-free plate 18 similar test bars were taken. With tese ultimate tensile strength values of between 48.2 and 55.4 kp/mm² were obtained in 15 cases, whereas the values of 3 cases were considerably lower, namely 16.9, 23.3 and 31.8, respectively. Obviously, the risk for breakage at relatively low loads, down to below one-third of the average strength of the material, is pronounced in the Te-free material, whereas no corresponding risk is present with regard to the material containing Te. The results are summarized in table 2.

Table 2

Strength and contraction in the thickness direction for 25 mm plates with or without Te-addition.

| Test Ser. No. | Bar No. | Ingot 1 0.011 % Te Ultimate strength kp/mm² | Con-trac-tion % | Ingot 2 0 % Te Ultimate Strength kp/mm² | Con-trac-tion % | Ingot 3 0.011 % Te Ultimate strength kp/mm² | Con-trac-tion % |
|---|---|---|---|---|---|---|---|
| 1 | 1 | 55.2 | 30 | 54.2 | 19 | 55.6 | 20 |
| | 2 | 55.6 | 29 | 48.2 | 18 | 54.5 | 20 |
| | 3 | 50.6 | 15 | 50.0 | 13 | 53.8 | 23 |
| | 4 | 54.7 | 26 | 53.4 | 18 | 54.7 | 31 |
| | 5 | 51.2 | 21 | 53.4 | 18 | 51.8 | 43 |
| | 6 | 51.3 | 20 | 52.8 | 19 | 54.3 | 27 |
| | 7 | | | 49.9 | 11 | 53.8 | 22 |
| | 8 | | | 23.3 | (<10) | 53.8 | 23 |
| | 9 | | | 54.2 | 19 | 54.2 | 27 |
| 2 | 1 | 54.4 | 20 | 53.2 | 11 | 54.2 | 15 |
| | 2 | 56.5 | 27 | 31.8 | (<10) | 54.8 | 17 |
| | 3 | 56.5 | 38 | 53.6 | 23 | 55.4 | 20 |
| | 4 | 56.3 | 27 | 16.9 | (<10) | 55.4 | 26 |
| | 5 | 49.2 | 28 | 52.5 | 13 | 55.1 | 31 |
| | 6 | 56.6 | 16 | 53.4 | 16 | 48.2 | 14 |
| | 7 | 56.3 | 24 | 54.2 | 19 | 55.4 | 12 |
| | 8 | 54.5 | 19 | 54.4 | 13 | 55.6 | 22 |
| | 9 | | | 50.6 | 15 | 54.0 | 17 |

EXAMPLE 4.

A tube steel was prepared from a charge having the base composition:

| C | Si | Mn | P | S | Cr | Al | Nb | |
|---|---|---|---|---|---|---|---|---|
| .13 | .46 | 1.56 | .012 | .022 | .15 | .041 | .035 | % |

The charge was cast in a continuous casting machine, and to part of the charge Te was added in an amount of 100 g/ton giving an analyzed content of 0.006% Te. Material was taken from said part and was rolled to 16 mm plate and tested in comparison with corresponding sheet from the remaining part of the charge, i.a. with regard to notch toughness according to Charpy V longitudinally as well as transversely, the following results being obtained on impact work at 100% tough break $vE_{100}$.

Table 3

| | $vE_{100}$, transverse | kpms longitudinal | $vE_{100}$ transverse / $vE_{100}$ longitudinal |
|---|---|---|---|
| Material from control blank 1 (before test blank) | 5.0 | 16.5 | 0.30 |
| Material from test blank with 0.006 % Te | 12.7 | 20.0 | 0.64 |
| Material from control blank 2 (after test blank) | 5.0 | 13.4 | 0.37 |

From this follows that tubes manufactures by longitudinal welding of rolled sheet obtain considerably higher ductility in the direction of highest load (circumferential direction) if prepared from the Te-containing material. Since the ratio $vE_{100}$ transverse/$vE_{100}$ longitudinal is considerably higher for the latter material, the result also means that the Te-containing material is utilized in a considerably more efficient manner than the non-Te-containing.

EXAMPLE 5

In the same way as in Example 4 tellurium was added to a part of a big charge. Analysis (exclusive of tellurium):

| C | Si | Mn | P | S | N | Al | |
|---|---|---|---|---|---|---|---|
| .12 | .30 | 1.22 | .012 | .015 | .005 | .061 | % |

After rolling to 25 mm plate 2 plates with tellurium added thereto (analyzed content 0.007%) were investigated. Notch values at completely tough break, $vE_{100}$, were:

Table 4

| | $vE_{100}$ transverse kpms | $vE_{100}$ longitudinal kpms | $vE_{100}$ transverse / $vE_{100}$ longitudinal |
|---|---|---|---|
| Control plate 1 | 11.3 | 24.2 | 0.47 |
| Te-containing plate 1, .007 % Te | 19.5 | 24.6 | 0.79 |
| Te-containing plate 2, .007 % Te | 17.2 | 26.1 | 0.69 |
| Control plate 2 | 11.5 | 24.7 | 0.47 |

EXAMPLE 6

From one and the same charge having the analysis:

| C | Si | Mn | P | S | N | Al-solub. | |
|---|---|---|---|---|---|---|---|
| .12 | .29 | 1.26 | .012 | .019 | .010 | .045 | % |

ingots were prepared. To one ingot Te was added to an analyzed content of 0.009%, whereas another ingot served as a control. Plates having a thickness of 10 mms were rolled from the ingots and were then normalized at 910° C. Bending tests were carried out on both plates, the bending axis extending along the rolling direction. The Te-containing plate could without formation of cracks be bent over an edge radius of 3 mms, whereas the Te-free control material displayed deep cracks along the outer edge of the bent section already at an edge radius of 7 mms.

EXAMPLE 7

The steels of Examples 4 and 5 have been investigated with regard to strength (ultimate strength) and ductility (contraction) by tensile tests in the direction of the thickness (perpendicular to the rolling plane), the following results being obtained:

Table 5

| | Ultimate strength kp/mm² $\sigma B'$ average value | lowest value | Contraction $\psi$ % average value |
|---|---|---|---|
| Steel from Example 4 | | | |
| Plate from control blank 1 (before test blank) | 56.3 | 49.4 | 22 |
| Plate from test blank with 0.006 % Te | 58.4 | 57.8 | 48 |
| Plate from control blank 2 (after test blank) | 53.6 | 49.3 | 11 |
| Steel from Example 5 | | | |
| Plate from control blank 1 | 47.6 | 43.2 | 42 |
| Plate from test blank with 0.007 % Te | 47.9 | 46.3 | 63 |

From this it is clear that also the Te-containing steels from Examples 4 and 5 have considerably better strength characteristics also in direction of the thickness than their respective control steels, particularly with regard to contraction. The latter characteristic is of a particular importance, since in an empirical manner a correlation between high contraction and suitability for certain types of constructions having loads in the direction of the thickness have been found.

The invention is applicable to a plurality of rolled steels both low strength and high strength steels. Particularly advantageous it has been found in qualified, weldable construction steels having a sulphur content of 0.002 – 0.03%.

What is claimed is:

1. In a structural article made of a rolled steel, said article being subjected to tensile stress component in a direction perpendicular to the rolled direction of said steel and at least equal to or greater than the predetermined tensile stress component in said rolled direction of said steel material, the improvement comprising said steel having a composition consisting essentially of 0.01 – 0.35% C, up to 1.0% Si, 0.3 – 5% Mn, up to 3% Cr, up to 10% Ni, up to 1% Mo, up to 0.15% Nb, up to 0.15% V, up to 0.6% Cu, 0.005 – 0.1% Al, up to 0.030% N, up to 0.006% B and a normal percentage of iron contaminating elements, about 0.002 – 0.05% by weight of sulfur, and tellurium, in an amount of about 0.002 – 0.009% by weight + about 0.1 times the sulphur content in percent by weight, an amount of silicate bound oxygen in said steel not exceeding about 300 parts per million, and balance iron.

* * * * *